US006014774A

United States Patent [19]

Davey et al.

[11] Patent Number: 6,014,774

[45] Date of Patent: Jan. 18, 2000

[54] MITTEN HAVING A RETRACTABLE BACK PORTION

[76] Inventors: Martha Davey; Steven Drozd, both of 780 Mohawk Rd. West #1017, Hamilton, Canada, L9C 6P7

[21] Appl. No.: 09/108,758

[22] Filed: Jul. 1, 1998

[51] Int. Cl.[7] ..... A41D 19/01

[52] U.S. Cl. ..... 2/158; 2/161.4; 2/162

[58] Field of Search ..... 2/158, 159, 161.1, 2/161.2, 161.4, 161.5, 161.6, 161.7, 162

[56] References Cited

U.S. PATENT DOCUMENTS 1,519,913 12/1924 Hynes ..... 2/158

5,444,874 8/1995 Samelian et al. ..... 2/159

5,620,621 4/1997 Sontag ..... 2/158

*Primary Examiner*—Diana Oleksa

[57] ABSTRACT

A mitten having a retractable back portion for facilitating the positioning of the mitten upon the wearer's hand. The inventive device includes a palm portion and a back portion, the back portion including an integrally hinged flap portion which is releasably attachable to the back portion. The palm portion and back portion are peripherally attached to define a cavity therebetween. The cavity includes a thumb portion for receiving a thumb of the hand and an opening for receiving the hand therethrough.

6 Claims, 2 Drawing Sheets

MITTEN HAVING A RETRACTABLE BACK PORTION

BACKGROUND OF THE INVENTION

1. Field of the Invention

The present invention relates to mittens and more particularly pertains to a new mitten having a retractable back portion for facilitating the positioning of the mitten upon the wearer's hand.

2. Description of the Prior Art

The use of mittens is known in the prior art. More specifically, mittens heretofore devised and utilized are known to consist basically of familiar, expected and obvious structural configurations, notwithstanding the myriad of designs encompassed by the crowded prior art which have been developed for the fulfillment of countless objectives and requirements.

Known prior art mittens include U.S. Pat. No. 2,411,926; U.S. Pat. No. 2,274,335; U.S. Pat. No. 4,104,740; U.S. Pat. No. 4,194,248; U.S. Pat. No. 2,283,561 and U.S. Pat. No. Des. 282,981.

While these devices fulfill their respective, particular objectives and requirements, the aforementioned patents do not disclose a new mitten having a retractable back portion. The retractable back portion is particularly advantageous for use with persons having a disability or otherwise being unable to easily insert their hands into conventional mittens. By providing a retractable back portion consisting of a flap portion formed on a back portion of the mitten, a cavity formed inside the mitten is easily accessible even by small children. The inventive device includes a palm portion and a back portion, the back portion including an integrally hinged flap portion which is releasably attachable to the back portion. The palm portion and back portion are peripherally attached to define a cavity therebetween. The cavity includes a thumb portion for receiving a thumb of the hand and an opening for receiving the hand therethrough.

In these respects, the mitten having a retractable back portion according to the present invention substantially departs from the conventional concepts and designs of the prior art, and in so doing provides an apparatus primarily developed for the purpose of facilitating the positioning of the mitten upon the wearer's hand.

SUMMARY OF THE INVENTION

In view of the foregoing disadvantages inherent in the known types of mittens now present in the prior art, the present invention provides a new mitten having a retractable back portion construction wherein the same can be utilized for facilitating the positioning of the mitten upon the wearer's hand.

The general purpose of the present invention, which will be described subsequently in greater detail, is to provide a new mitten having a retractable back portion apparatus and method which has many of the advantages of the mittens mentioned heretofore and many novel features that result in a new mitten having a retractable back portion which is not anticipated, rendered obvious, suggested, or even implied by any of the prior art mittens, either alone or in any combination thereof.

To attain this, the present invention generally comprises a palm portion and a back portion, the back portion including an integrally hinged flap portion which is releasably attachable to the back portion. The palm portion and back portion are peripherally attached to define a cavity therebetween.

The cavity includes a thumb portion for receiving a thumb of the hand and an opening for receiving the hand therethrough.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new mitten having a retractable back portion apparatus and method which has many of the advantages of the mittens mentioned heretofore and many novel features that result in a new mitten having a retractable back portion which is not anticipated, rendered obvious, suggested, or even implied by any of the prior art mittens, either alone or in any combination thereof.

It is another object of the present invention to provide a new mitten having a retractable back portion which may be easily and efficiently manufactured and marketed.

It is a further object of the present invention to provide a new mitten having a retractable back portion which is of a durable and reliable construction.

An even further object of the present invention is to provide a new mitten having a retractable back portion which is susceptible of a low cost of manufacture with regard to both materials and labor, and which accordingly is then susceptible of low prices of sale to the consuming public, thereby making such mitten having a retractable back portion economically available to the buying public.

Still yet another object of the present invention is to provide a new mitten having a retractable back portion which provides in the apparatuses and methods of the prior art some of the advantages thereof, while simultaneously overcoming some of the disadvantages normally associated therewith.

Still another object of the present invention is to provide a new mitten having a retractable back portion for facilitating the positioning of the mitten upon the wearer's hand.

Yet another object of the present invention is to provide a new mitten having a retractable back portion which includes a palm portion and a back portion, the back portion including an integrally hinged flap portion which is releasably attachable to the back portion. The palm portion and back portion are peripherally attached to define a cavity therebetween. The cavity includes a thumb portion for receiving a thumb of the hand and an opening for receiving the hand therethrough.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
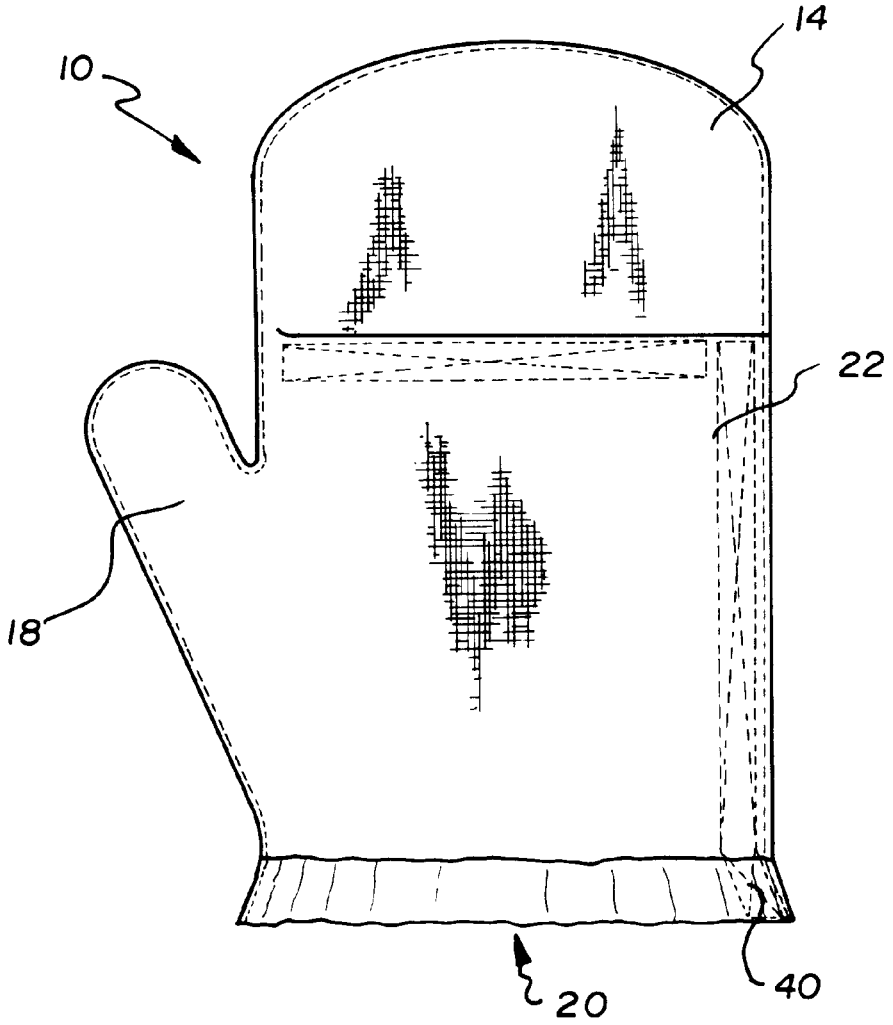
FIG. 1 is a plan view of a new mitten having a retractable back portion according to the present invention.
Figure 2:
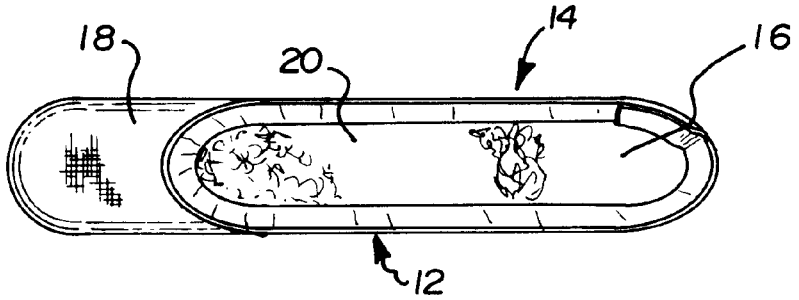
FIG. 2 is an end elevation view thereof.

With reference now to the drawings, and in particular to FIGS. 1 through 4 thereof, a new mitten having a retractable back portion embodying the principles and concepts of the present invention and generally designated by the reference numeral 10 will be described.

More specifically, it will be noted that the mitten having a retractable back portion 10 comprises a palm portion 12 and a back portion 14. The back portion 14 and the palm portion 12 are peripherally attached as by sewing to define a cavity 16 therebetween. The cavity 16 includes a thumb section 18 for receiving a thumb of the wearer's hand. The cavity 16 also includes an opening 20 for receiving the hand of the wearer in a conventional manner. The back portion 14 further includes an integrally formed and hinged flap portion 22 which is releasably attachable to the back portion 14.

Figure 3:
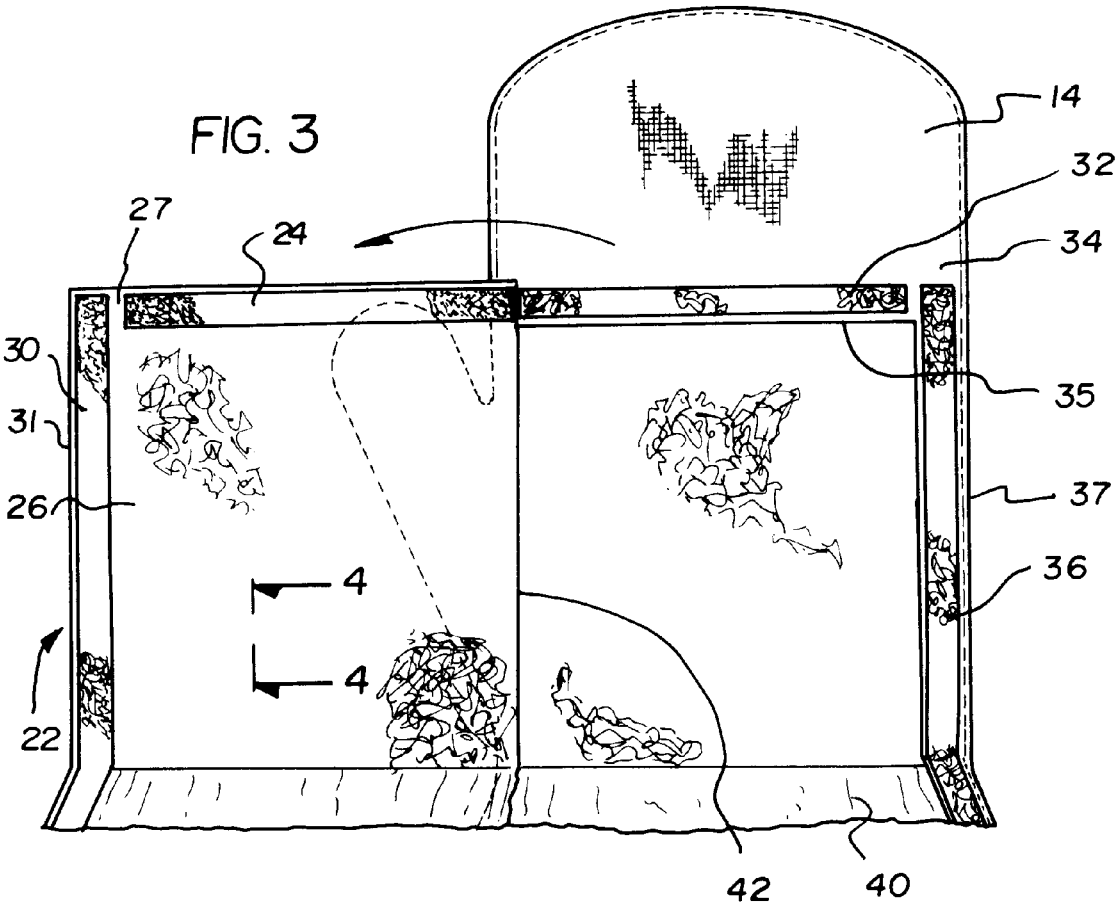
FIG. 3 is a plan view showing the mitten of the present invention showing the retractable back portion in it's retracted position.

With reference to FIG. 3 a means for releasably attaching the flap portion 22 to the back portion 14 is shown including a first fastening means 24 fixedly attached proximate an upper edge 27 of a flap portion inside layer 26. The first fastening means 24 is releasably attachable to a third fastening means 32 shown fixedly attached proximate a lower edge 35 of a back portion outside layer 34. A second fastening means 30 is shown fixedly attached proximate a free side edge 31 of the flap portion inside layer 26. The second fastening means 30 is releasably attachable to a fourth fastening means 36 fixedly attached proximate a lateral portion 37 of the back portion outside layer 34. The first and second fastening means 24 and 30 are preferably formed of a first component of a hook and eye fastening system such as Velcro™ while the third and fourth fastening means 32 and 36 are preferably formed of a second component of the hook and eye fastening system.

With continued reference to FIG. 3 the flap portion 22 is shown integrally formed to the back portion 14. The flap portion 22 is pivotable and retractable from the back portion 14 along a hinge line 42. In this manner the cavity 16 of the mitten 10 is made smaller in order to facilitate the insertion of the wearer's hand into the cavity 16. Once the wearer's hand is inserted into the cavity 16, the flap portion 22 can be releasably secured to the back portion 14 as described hereinbefore.

Figure 4:
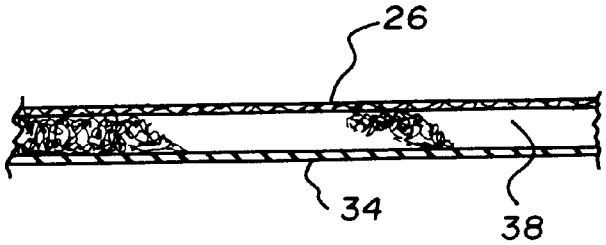
FIG. 4 is a cross sectional view taken along line 4—4 of FIG. 3.

With reference to FIG. 4, the palm portion 12 and back portion 14, to include the flap portion 22, preferably include an outside layer 34 formed of a water resistant material of a type well know in the art, an inner layer 38 formed of an insulating material, and an inside layer 26 formed of a cotton fabric material.

With reference to FIGS. 1 and 3, the palm portion 12 and back portion 14 are shown each having an opening portion 40 disposed proximate the opening 20 of the cavity 16 of the mitten 10. The opening lo portion 40 is shown having a greater lateral dimension than the palm portion 12 and the back portion 14. As shown the second fastening means 30 and fourth fastening means 36 extend to the opening portions 40 in order to complete the attachment of the flap portion 22 to the back portion 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A mitten for a hand comprising:

a palm portion having an outside layer, an inner layer, and an inside layer;

a back portion consisting of an upper back portion and a lower back portion each having an outside layer, an inner layer, and an inside layer, the back portion and palm portion being peripherally attached to define a cavity therebetween, the cavity having a thumb section for receiving a thumb of the hand and an opening for receiving the hand therethrough, the lower back portion consisting of a lateral portion and an integrally hinged flap portion, having an upper edge, a lower edge, an affixed side edge, and a free side edge;

a first fastening means fixedly attached proximate the upper edge of the flap portion inside layer; and a second fastening means fixedly attached proximate the free side edge of the flap portion inside layer, the first fastening means being releasably attachable to a third fastening means fixedly attached proximate a lower edge of the upper back portion outside layer and the second fastening means being releasably attachable to a fourth fastening means fixedly attached proximate the lateral portion of the back portion outside layer.

2. The mitten of claim 1, wherein the first and second fastening means further comprise a first component of a hook and eye fastening system and the third and fourth fastening means further comprise a second component of a hook and eye fastening system.

3. The mitten of claim 1, wherein the outside layer further comprises a water resistant material.

4. The mitten of claim 1, wherein the inner layer further comprises an insulating material.

5. The mitten of claim 1, wherein the inside layer further comprises a cotton fabric material.

6. The mitten of claim 1, wherein the palm portion and the back portion further comprise an opening portion, the opening portion being disposed proximate the opening of the cavity.

* * * * *